US005184422A

United States Patent [19]

Wade et al.

[11] Patent Number: 5,184,422

[45] Date of Patent: Feb. 9, 1993

[54] SWING AWAY MANWAY ASSEMBLY

[75] Inventors: William W. Wade, Overland Park, Kans.; Vincent W. Eshnaur, Kansas City, Mo.

[73] Assignee: American Ingredients Company, Kansas City, Mo.

[21] Appl. No.: 805,467

[22] Filed: Dec. 10, 1991

[51] Int. Cl.[5] ..... E05D 7/06; E05F 1/04

[52] U.S. Cl. ..... 49/239; 49/41; 49/247; 49/394; 52/20; 404/25

[58] Field of Search ..... 49/465, 236, 247, 394, 49/239, 41; 404/25; 52/20

[56] References Cited

U.S. PATENT DOCUMENTS

| | | | |
|---|---|---|---|
| 1,158,875 | 11/1915 | Warman | 49/247 X |
| 1,226,766 | 5/1917 | Gammeter | 49/247 X |
| 1,241,397 | 9/1917 | Keith | 49/247 X |
| 1,610,766 | 12/1926 | Gildersleeve | 49/247 |
| 3,605,337 | 5/1969 | Rodgers | 49/41 |
| 4,391,020 | 7/1983 | Hsu | 49/239 X |
| 4,607,760 | 8/1986 | Roche | 49/465 X |

*Primary Examiner*—Philip C. Kannan

*Attorney, Agent, or Firm*—Hovey, Williams, Timmons & Collins

[57] ABSTRACT

A swing away manway assembly for a tubular fluid conveying system having a manway opening in a first horizontal plane, the assembly including a cover disposed in a second parallel horizontal plane. The manway cover includes a circumferential sealing means for continuous sealing of the manway opening. The cover is provided with latch means for alternatively engaging and releasing the sealing means. Swing away means is secured to the cover in a plane perpendicular to the first and second horizontal planes of the cover and opening. The swing away means is adapted to facilitate swinging movement of the cover in a horizontal plane upon release of the sealing means. The swing away means includes biasing means for cooperation with the latch means in urging sealing engagement of the cover with the opening, and cam means for limited vertical movement of the cover during horizontal rotation thereof.

5 Claims, 1 Drawing Sheet

SWING AWAY MANWAY ASSEMBLY

BACKGROUND OF THE INVENTION

1. Field of the Invention

The present invention relates generally to devices for releasably sealing manway openings in tubular fluid conveying systems, and in particular to an apparatus to facilitate releasable sealing of a manway opening in a tubular system for conveying processed food products in liquified form, wherein a swing away assembly permits unsealing of the opening by rotational movement of a manway opening cover about a vertical axis, and limited vertical movement of the cover during such rotational movement.

2. Discussion of the Prior Art

It is known to provide a manway opening in a tubular fluid conveying system. For example, it has long been the practice to provide municipal sewer and water systems with manways, in order to give maintenance personnel access to the interior of such systems. Such manways are traditionally sealed by manway opening covers, which may or may not be integral to such systems by mechanical attachment therewith.

It is also known to provide a manway opening in a commercial tubular fluid conveying system, such as, for example, in food processing operations and the like. Such systems are generally unlike municipal applications in that the former are generally of more reduced scope, and may also be adapted to convey fluids at a variety of pressure levels. For these reasons, commercial fluid conveying systems often include manway openings having releasable covers that are mechanically integrated with the system and capable of forming a tight seal therewith.

Most conventional manway opening covers of the commercial type are attached to the tubular structure by a simple hinge device. In the typical case, the hinge includes a horizontal pivot axis. In this way, most manway covers are opened by lifting the cover in a 180° arc about the pivot axis. Therefore, the manway cover is moved vertically, requiring that there be available sufficient space to accommodate the full diameter of the cover as it is lifted through its arc. In many cases, this requires clearance of more than 24 inches. Obviously, in circumstances where such clearance is not available, the use of a traditional manway opening cover may be prohibited. This presents serious problems where access is necessary and space limited.

SUMMARY OF THE INVENTION

It is an object of the present invention to provide a swing away manway assembly wherein a manway cover includes circumferential sealing means for continuous sealing of a manway opening.

It is a further object of the present invention to provide a releasably sealing manway cover including a swing away assembly for facilitating movement of said cover in a horizontal plane for alternate opening and sealing of a manway.

It is another object of the present invention to provide a releasably sealing manway cover wherein the swing away assembly includes means for biasing a manway cover against a manway opening for continuous sealing thereof.

It is yet a further object of the present invention to provide a releasably sealing manway cover wherein the swing away assembly includes means for securing limited vertical movement of a manway cover during horizonal movement thereof to promote unsealing of the manway opening.

In accordance with the invention, a swing away manway assembly is provided, wherein a manway opening cover is provided, the cover disposed in a second horizontal plane parallel to the first horizontal plane of a manway opening. The manway opening cover includes a circumferential sealing means adapted for continuous sealing of the manway opening. The manway opening cover has latch means for alternatively engaging and releasing the circumferential sealing means. Swing away means is secured to the manway cover opposite the latch means. The swing away means is in a plane perpendicular to the horizontal plane of the manway cover, and is adapted to facilitate swinging movement of the cover in a horizontal plane upon release of the circumferential sealing means. The swing away means further includes biasing means for cooperating with the latch to promote sealing of the manway opening when the cover is in the closed position, and means for urging limited vertical movement of the cover during swinging horizontal movement thereof.

BRIEF DESCRIPTION OF THE DRAWINGS

A preferred embodiment of the invention is described in detail below with reference to the attached drawing figures, wherein.

DETAILED DESCRIPTION OF THE PREFERRED EMBODIMENT

Figure 1:
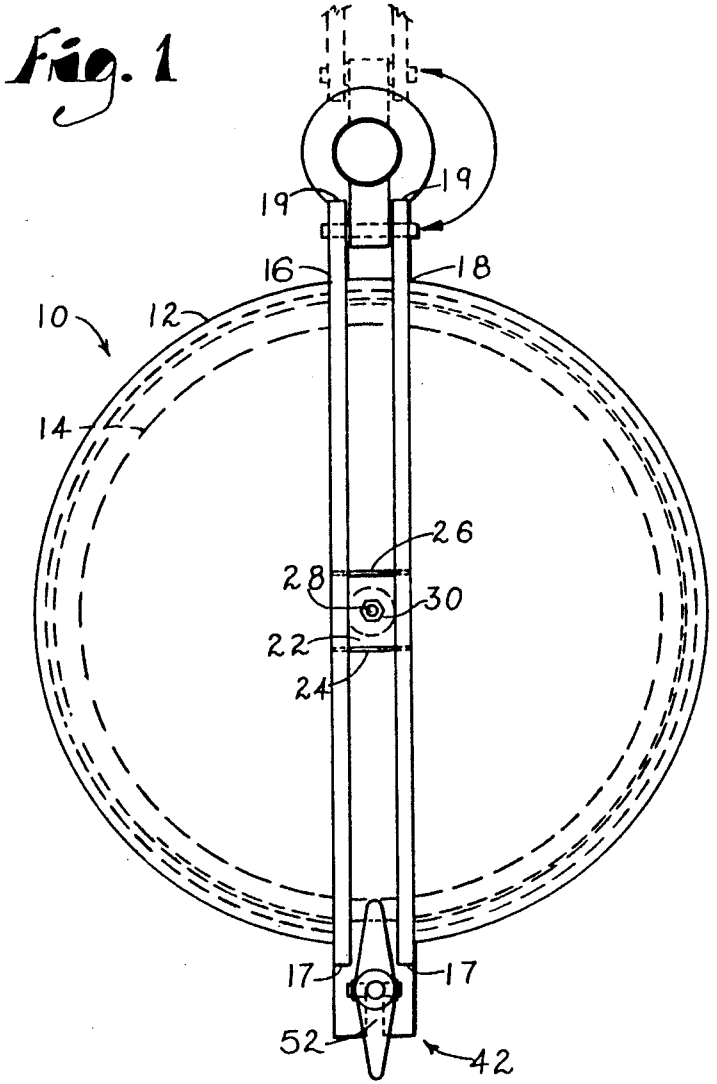
FIG. 1 is a top plan view of a swing away manway apparatus, constructed in accordance with the preferred embodiment.

A swing away manway assembly constructed in accordance with a preferred embodiment of the present invention is illustrated in FIG. 1. The environment in which the manway occurs may take a variety of forms in a commercial setting, including a tubular fluid conveying system, or alternatively a large receptacle containing fluids or other products. In such circumstances, the manway is typically located on an upper surface of the structure, and includes a circular opening with a circumferential edge disposed in a generally horizontal plane. In the illustrated example, the invention 10 includes a circular manway cover 12 sized to fit a manway opening 14. Manway cover 12 has a bracket consisting in part of parallel, spaced apart elongate members 16 and 18. Elongate members 16, 18 each present a first end 17 and a second end 19.

Figure 2:
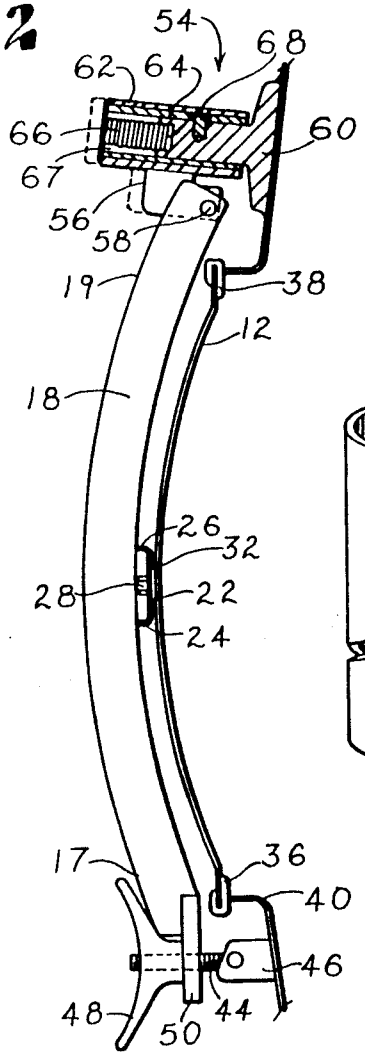
FIG. 2 is a side elevation of the swing away manway assembly of FIG. 1, partially in section, illustrating the limited vertical movement capability of the support elements in phantom lines.

Elongate members 16, 18 are secured to manway cover 12 by means of attachment structure 20. The structure 20 has a plate 22, which includes upright members 24 and 26, as illustrated in FIG. 2. Bolt 28 is integral to manway cover 12. The plate 22 is fitted over bolt 28 and separated from the cover 12 by a washer 32. Nut 30 is threadably engaged with bolt 28 for secure attachment of plate 22 to cover 12. In the illustrated example, elongate members 16, 18 are attached to upright members 24, 26 by any conventional means, such as by welding or the like.

Referring now to FIG. 2, the manway cover 12 includes a circumferential lip 36, to which is affixed circumferential seal 38. The manway opening 14 presents a circumferential manway lip 40 adapted for sealing engagement with the seal 38. FIG. 2 discloses that manway cover 12 has an integral fastening means or latch structure 42. The structure 42 includes a bolt 44 supported by a base structure 46. The bolt 44 is threaded for engagement With wing nut 48. As illustrated in FIGS. 1 and 2, a latch plate 50 is attached to elongate members 16, 18 by any conventional means. As best shown in FIG. 1, the plate 50 features a groove 52 which is positioned to allow the bolt 44 to pass through the plate 50. This permits the cover 12 to be disengaged from the bolt 44 without detaching the plate 50 from the cover 12.

Figure 3:
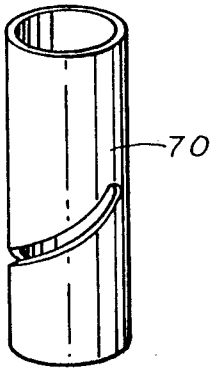
FIG. 3 is a perspective view of an inner sleeve of the swing away structure illustrating a cam path formed in the sleeve.

FIGS. 2 and 3 illustrate in detail the swing away structure 54, for supporting the cover bracket, which in the illustrated example is positioned on the cover 12 opposite the latch structure 42. The structure 54 has a first support structure or post 60, which is surmounted by inner sleeve 64 and outer sleeve 62. The structure 54 also includes a second support structure or hinge 56 to which elongate members 16, 18 are movably attached by a hinge bolt 58. The hinge 56 is secured to outer sleeve 62, and the outer sleeve 62 and inner sleeve 64 are movable together with respect to the post 60.

Swing away structure 54 further includes biasing means for aiding the lifting of cover 12. The preferred embodiment of the biasing means is a compression spring 66, disposed in a cavity 67 formed between the inner sleeve 64 and the post 60. The post 60 also includes pin 68 shown in FIG. 2. The pin 68 is fixed relative to post 60 and extends radially outward therefrom.

The inner sleeve 64 includes a cam path 70, as shown in FIG. 3, in which the pin 68 is received. The cam path 70 is inclined in order to cause the cover 12 to be lifted relative to the post 60 when the cover 12 is moved from the closed to the open position. This movement, which is assisted by the spring 66, simplifies movement of the cover 12 over and away from the manway 14.

In accordance with the invention, any conventional tubular fluid conveying system is provided with a manway opening 14. A manway cover 12 is provided to cooperate with opening 14, for alternately opening and sealing thereof. When the manway opening 14 is closed, the circumferential lip 36 and seal 38 are securely engaged with manway lip 40. In the closed position, the latch structure 42 is engaged with the cover 12, so that the bolt 44 is extended through the plate 50 and threadably engaged with the wing nut 48.

Opening and movement of the swing away manway assembly of the present invention begins by loosening of the wing nut 48 from bolt 44 by an amount sufficient to permit the wing nut 48 and bolt 44 to be pivoted away from the latch plate 50. By lifting the latch plate 50, the engagement between the circumferential seal 38 and the manway lip 40 is broken. The cover 12 is lifted so that horizontal movement of the cover 12 is possible. Compression spring 66 assists in this lifting by application of continuous pressure within cavity 67. Thereafter, by horizontal pressure against the cover 12, the entire assembly may be moved horizontally in a 180° arc, or at least such minimal distance as is required for the cover 12 to clear the manway 14.

In the disengagement of the cover 12 from the manway 14, and subsequent horizontal movement of the cover away from the opening, the pin 68 moves along the cam path 70 to the full extent thereof. This movement continues as the cover 12 is moved further in a horizontal direction away from the opening 14. As illustrated by the phantom lines in FIG. 2, this movement of pin 68 along path 70 raises the cover 12 sufficiently to provide clearance between the cover and the manway structure and continues to raise the cover 12 a limited distance as horizontal rotation proceeds.

It will be observed that by the means discussed above, the present invention permits the full use of a manway cover in a confined space. By use of the present invention, therefore, a manway cover may be opened and completely moved away from a manway opening to allow access to the fluid stream, even where space is confined in such manner that a conventional manway cover of 18 to 24 inch diameter would be incapable of vertical opening in the normal manner.

Although the invention has been described with reference to the illustrated preferred embodiment, it is noted that variations and changes may be made and equivalents employed herein without departing from the scope of the invention as recited in the claims.

We claim:

1. A swing away manway assembly for use in covering a hole defined by a circumferential edge that is disposed within a first plane, the assembly comprising:

a manway opening cover disposed in a second plane parallel to said first plane;

said cover including circumferential sealing means adapted for continuous sealing of said manway opening;

latch means for alternatively engaging and releasing said cover circumferential sealing means;

swing away means secured to said cover and lying in a plane perpendicular to said first and second planes;

said swing away means adapted to facilitate swinging movement of said cover upon release of said circumferential sealing means;

said swing away means including biasing means cooperating with said latch means to facilitate continuous sealing of said manway opening with said cover circumferential sealing means; and said swing away means further including cam means for moving the cover vertically during swinging movement thereof.

2. A manway hole cover assembly for use in covering a hole defined by a circumferential edge that is disposed within a first plane, the cover assembly comprising:

a cover formed of a size and shape to cover a manway hole when placed over the hole;

cover retaining means for retaining the cover in position on the manway hole, the cover retaining means including;

a bracket extending diametrically across the cover and including first and second ends;

fastening means for fastening the first end of the bracket relative to the hole once the cover is placed over the hole;

support means for supporting the second end of the bracket relative to the hole, the support means including a first support element that remains stationary relative to the hole and defines an axis extending in a direction generally perpendicular to the first plane, a second support element that is fastened to the second end of the bracket and supported on the first element for rotation about the axis, and cam means for moving the second support element longitudinally relative to the axis during rotation of the second element so that the cover and bracket may be swung about the axis between a lowered position over the manway hole and a raised position removed from the manway hole; and biasing means for biasing the second support element against the force of gravity in order to assist movement of the cover apparatus from the lowered position over the manway hole to the raised position removed from the manway hole.

3. The manway hole cover assembly as set forth in claim 2, wherein said bracket is supported for swinging movement relative to said second support element.

4. The manway hole cover assembly as set forth in claim 2 wherein said biasing means is a compression means between said first and second element.

5. The manway hole cover assembly as set forth in claim 2 wherein said cam means includes a cam path on one said element and a cam follower on another said element.

* * * * *